US010900707B2

(12) United States Patent
Lim

(10) Patent No.: US 10,900,707 B2
(45) Date of Patent: Jan. 26, 2021

(54) REFRIGERATOR

(71) Applicant: LG Electronics Inc., Seoul (KR)

(72) Inventor: Kiyoung Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/511,424

(22) Filed: Jul. 15, 2019

(65) Prior Publication Data

US 2019/0339000 A1 Nov. 7, 2019

Related U.S. Application Data

(63) Continuation of application No. 15/479,937, filed on Apr. 5, 2017, now Pat. No. 10,352,612.

(30) Foreign Application Priority Data

Apr. 5, 2016 (KR) ..... 10-2016-0041769

(51) Int. Cl.
*F25D 23/04* (2006.01)
*A47B 57/10* (2006.01)
(Continued)

(52) U.S. Cl.
CPC ..... *F25D 23/04* (2013.01); *A47B 57/10* (2013.01); *F25D 23/025* (2013.01);
(Continued)

(58) Field of Classification Search
CPC ..... F25D 23/00; F25D 23/02; F25D 23/028; F25D 23/04
(Continued)

(56) References Cited

U.S. PATENT DOCUMENTS

2006/0152123 A1 7/2006 Collins et al.
2010/0270902 A1* 10/2010 Kim ..... F25D 23/04 312/405.1
(Continued)

FOREIGN PATENT DOCUMENTS

CN 100533021 C 8/2009
CN 102338525 2/2012
(Continued)

OTHER PUBLICATIONS

Extended European Search Report in European Application No. 17164926.2, dated Jun. 9, 2017, 7 pages (with English translation).
(Continued)

*Primary Examiner* — James O Hansen
(74) *Attorney, Agent, or Firm* — Fish & Richardson P.C.

(57) ABSTRACT

A refrigerator that includes: a cabinet; a first door; a second door; a moving basket that includes: a basket, a moving frame that is arranged to have a first distance between the moving frame and the basket, and a bridge that couples the basket to the moving frame; a rail that is coupled to the first door and that is configured to guide the moving basket; a supporting unit that is projected from the bridge toward the rail and that supports the moving basket; a lever that, based on user manipulation, to moves between a first position and a second position, wherein the moving frame is configured to accommodate at least a portion of the lever; and a stopper that is coupled to the rail based on a position of the lever and that is configured to stop the moving basket is disclosed.

20 Claims, 11 Drawing Sheets

(51) Int. Cl.
*F25D 23/02* (2006.01)
*F25D 23/06* (2006.01)
*F25D 25/04* (2006.01)

(52) U.S. Cl.
CPC ..... *F25D 23/067* (2013.01); *F25D 25/04* (2013.01); *F25D 2323/023* (2013.01)

(58) Field of Classification Search
USPC ..... 312/401, 405, 405.1, 321.5
See application file for complete search history.

(56) References Cited

U.S. PATENT DOCUMENTS

| | | | | |
|---|---|---|---|---|
| 2012/0018435 | A1 | 1/2012 | Kim | |
| 2012/0293056 | A1 | 11/2012 | Kim | |
| 2013/0081421 | A1* | 4/2013 | Kwon | F25D 11/00 62/440 |
| 2013/0119845 | A1 | 5/2013 | Seo et al. | |
| 2014/0042886 | A1 | 2/2014 | Baldo | |
| 2014/0062283 | A1 | 3/2014 | Baldo | |
| 2014/0312758 | A1* | 10/2014 | Gossens | F25D 23/04 312/404 |
| 2014/0366569 | A1 | 12/2014 | Babinski et al. | |

FOREIGN PATENT DOCUMENTS

| | | |
|---|---|---|
| CN | 102494484 | 6/2012 |
| CN | 103105039 | 5/2013 |
| CN | 104215025 | 12/2014 |
| JP | 2013108638 | 6/2013 |
| KR | 200265318 | 6/2002 |
| KR | 1020070013137 | 1/2007 |
| KR | 100814691 | 3/2008 |
| KR | 20130036673 | 4/2013 |
| KR | 10-2013-0053593 | 5/2013 |
| KR | 10-2014-0048102 | 4/2014 |
| KR | 1020140124119 | 10/2014 |

OTHER PUBLICATIONS

Chinese Office Action in Chinese Application No. 201710217533.9, dated Jun. 1, 2020, 11 pages (with English translation).

Extended European Search Report in European Application No. 20157114.8, dated Jun. 9, 2020, 6 pages.

* cited by examiner

REFRIGERATOR

CROSS-REFERENCE TO RELATED APPLICATION

This application is a continuation of U.S. application Ser. No. 15/479,937, filed on Apr. 5, 2017, now allowed, which claims the benefit of earlier filing date and right of priority to Korean Application No. 10-2016-0041769, filed on Apr. 5, 2016, the entire contents of which are hereby incorporated by reference in their entirety.

TECHNICAL FIELD

The present application relates to technologies related to a refrigerator.

BACKGROUND

Generally, a refrigerator is an electric appliance including a cabinet and a door filled with a heat insulating material to define a food storage chamber capable of cutting off external heat and configured to keep foods fresh in a range of low temperatures for a long time without spoilage, using a freezing mechanism consisting of an evaporator for absorbing internal heat of the food storage chamber and a heat radiating device for exhausting the collected heat. The range of the low temperatures means the range in which microorganisms are not able to survive or proliferate.

Such a refrigerator is configured of a refrigerator compartment for storing foods in temperature ranges above zero and a freezer compartment for storing foods in temperature ranges below zero. Based on the arrangement of the refrigerator and freezer compartments, the refrigerator may be classified into a top freezer type freezer type, a bottom freezer type and a side by side type. The top freezer type includes a top freezer compartment and a bottom refrigerator compartment. The bottom freezer type includes a bottom freezer compartment and a top refrigerator compartment. The side by side type includes a right freezer compartment and a left refrigerator compartment. A plurality of racks and drawers may be provided in the food storage chamber to allow a user to put or take out the foods stored in the food storage chamber.

A home-bar, an ice maker, s rack or a basket may be mounted in a rear surface of the door provided in the refrigerator and the rear surface of the door is used as an auxiliary storage chamber or functional space recently. In other words, the function of the refrigerator door is not just to open and close the refrigerator or freezer compartment, it is way beyond that. The function of the refrigerator door is as diversified as the door defines the auxiliary storage chamber or supplies cold water and ice-cube.

Moreover, a double-door refrigerator including an auxiliary door coupled to a main door for opening and closing the storage compartment has been released and such a double-door refrigerator is called door-in-door (DID) refrigerator. More specifically, a user opens a main door to use the storage compartment and opens only a sub-door to use a sub-storage compartment in the DID refrigerator.

The sub-storage compartment is provided in a rear portion of the main door and it can mean the storage area partitioned off from the storage compartment by a partition (for example, a home bar case). It is a recent trend to form such the sub-storage area in a substantially entire area, not in a partial area of the main door.

In some implementations, the sub-storage compartment is provided to store not only water or beverages but also other various stored foods the user uses more often. Not one rack or basket but a plurality of racks or baskets may be provided in such the sub-storage compartment. However, the stored goods have diverse heights and in some implementations, the height (vertical length) of the rack or basket is variable.

For that, Korea Patent No. 10-2011-0118955 filed by the present applicant (hereinafter, the prior invention) discloses "Moving Basket" which may be vertically movable in a home bar.

In the prior art, a user can put or take out the foods stored in or from the moving basket through an opening formed in a main door (a food introduction opening of a sub-storage chamber. As occasion demands, the user can adjust the height of the moving basket by moving a lever.

However, the lever provided in the prior invention is located in a position exposed to the user as it is. In other words, the lever is located in an inner portion of the opening in a radial direction and it is difficult to realize a beautiful exterior design. As one example, when the user puts or takes out one or more food stuffs in or from the moving basket, one or more food stuffs happen to interfere with the lever disadvantageously.

More specifically, the lever of the prior invention is located in a lower portion of the moving basket, while projected downward and forward. Accordingly, using a lower basket of the moving basket, containers such as glass bottles might collide against the lever and damage the lever.

Also, it is difficult to vertically move the moving basket of the prior invention along the user's manipulation of the lever.

As one example, the user can move the moving basket upward by applying a force upward while raising both levers. In this instance, the user supports the load of the moving basket only by using the lever only to break the balance of the forces. Accordingly, the moving basket has to be moved upward in a very insecure state.

Similarly, the user can move the moving basket downward by using the load of the moving basket while raising the both levers upward. In this instance, the moving basket has to be moved downward by using only the load of the moving basket, in other words, an empty state of the moving basket. The moving basket might fail to be moved downward smoothly by interference of foreign substances and the like. In case quite heavy foods are kept in the moving basket, the load of the moving basket is supported by only using the lever only to break the balance of the power. Accordingly, the moving basket cannot help being moved downward in a quite insecure state.

In other words, it is disadvantageously difficult in the prior invention for the user to apply a force to the moving basket in a desired direction to move, together with the manipulation of the lever using the hand.

SUMMARY

In general, one innovative aspect of the subject matter described in this specification can be embodied in a refrigerator comprising: a cabinet that includes a storage compartment and an opening to the storage compartment; a first door that is configured to cover the opening to the storage compartment and that includes a first compartment and a first opening to the first compartment; a second door that is configured to cover the first opening to the first compartment and that is coupled to the first door; a moving basket that includes: a basket that is located inside the first compartment, a moving frame that is arranged to have a first distance between the moving frame and the basket and that includes a second opening through which an object passes to be stored in the basket, and a bridge that couples the basket to the moving frame; a rail that is coupled to the first door and that is configured to guide the moving basket; a supporting unit that is projected from the bridge toward the rail and that supports the moving basket; a lever that, based on user manipulation, to moves between a first position and a second position, wherein the moving frame is configured to accommodate at least a portion of the lever; and a stopper that is coupled to the rail based on a position of the lever and that is configured to stop the moving basket.

The foregoing and other implementations can each optionally include one or more of the following features, alone or in combination. In particular, one implementation includes all the following features in combination. Based on movement of the lever, the portion of the lever that is accommodated by the moving frame changes. The moving frame is configured to cover a first end of the lever. The rail includes: a first rail that is coupled to a first side of the first door, and a second rail that is coupled to a second side of the first door. The first rail and the second rail are coupled to a surface of the first door that faces the storage compartment, and wherein the first rail and the second rail are invisible from an exterior of the cabinet through the first opening. The lever is extended from the bridge and is accessible by a user through the first opening. The refrigerator further includes: a lever shaft about which the lever is configured to rotate, and a stopper shaft about which the stopper is configured to rotate. The refrigerator further includes: one or more springs that are coupled to at least one of the lever and the stopper and that are configured to, based on user manipulation of the lever, contract or extend to move at least one of the lever and the stopper. The basket and the moving frame are arranged to have a space between the basket and the moving frame, and wherein at least a portion of the lever is accessible by a user through the space. The moving frame is rectangular-shaped, and wherein the bridge is extended from the moving frame toward the basket. The moving frame includes, a first frame portion that is located at a first side of the bridge, and a second frame portion that is located at a second side of the bridge. The refrigerator further includes: a bracket that couples the bridge to the moving frame. The bracket couples the supporting unit, the lever, and the stopper to the moving frame, and wherein the lever and the stopper are configured to rotate. The bracket is configured to accommodate at least a portion of the supporting unit, the lever, and the stopper, and wherein the bridge is coupled to the bracket and is configured to cover the portion of the supporting unit, the lever, and the stopper.

In general, another innovative aspect of the subject matter described in this specification can be embodied in a refrigerator comprising: a cabinet that includes a storage compartment and an opening to the storage compartment; a first door that is configured to cover the opening to the storage compartment and that includes a first compartment and a first opening to the first compartment; a second door that is configured to cover the first opening to the first compartment and that is coupled to the first door; a moving basket that includes: a basket that is located inside the first compartment, a moving frame that is arranged to have a first distance between the moving frame and the basket and that includes a second opening through which an object passes to be stored in the basket, and a bridge that couples the basket to the moving frame; a rail that is coupled to the first door and that is configured to guide the moving basket; a supporting unit that is projected from the bridge toward the rail and that supports the moving basket; a lever that is located at a lower portion of the basket and that, based on user manipulation, moves between a first position and a second position, wherein the moving frame is configured to accommodate at least a portion of the lever; and a stopper that is coupled to the rail based on a position of the lever and that is configured to stop the moving basket.

The foregoing and other implementations can each optionally include one or more of the following features, alone or in combination. In particular, one implementation includes all the following features in combination. The basket and the moving frame are arranged to have a space between the basket and the moving frame, and wherein the basket and the lever are arranged to have a second distance between the basket and the lever. The supporting unit includes a first supporting unit and a second supporting unit, the lever includes a first lever and a second lever, and the stopper includes a first stopper and a second stopper, wherein the first supporting unit, the first lever, and the first stopper are located at a first side of the moving basket, and wherein the second supporting unit, the second lever, and the second stopper are located at a second side of the moving basket.

In general, another innovative aspect of the subject matter described in this specification can be embodied in a refrigerator comprising: a cabinet that includes a storage compartment and an opening to the storage compartment; a first door that is configured to cover the opening to the storage compartment and that includes a first compartment and a first opening to the first compartment; a second door that is configured to cover the first opening to the first compartment and that is coupled to the first door; a moving basket that includes: a basket that is located inside the first compartment, a moving frame (i) that is arranged to have a first distance between the moving frame and the basket (ii) that includes a second opening through which an object passes to be stored in the basket, and wherein at least a portion of the moving frame is configured to, based on user manipulation, move between a first position and a second position, a bridge that couples the basket to the moving frame; a rail that is coupled to the first door and that is configured to guide the moving basket; a supporting unit that is projected from the bridge toward the rail and that supports the moving basket; a stopper that is coupled to the rail based on a position of the portion of the moving frame and that is configured to stop the moving basket.

The foregoing and other implementations can each optionally include one or more of the following features, alone or in combination. In particular, one implementation includes all the following features in combination. The moving frame is rectangular-shaped, and wherein the bridge is extended from the moving frame toward the basket. The moving frame includes, a first frame portion that is located at a first side of the bridge and that is configured to, based on user manipulation, rotate between the first position and the second position, and a second frame portion that is located at a second side of the bridge.

The subject matter described in this specification can be implemented in particular implementation so as to realize one or more of the following advantages. Comparing to a conventional refrigerator, a refrigerator comprises a door including a moving basket that is securely supported by a stopper and a lever. In addition, the lever is accessible by a user through an opening such that the user can easily manipulate the movement of the moving basket. Furthermore, the lever is not visually exposed to an exterior area of a refrigerator.

The details of one or more implementations of the subject matter of this specification are set forth in the accompanying drawings and the description below. Other features, aspects, and advantages of the subject matter will become apparent from the description, the drawings, and the claims.

BRIEF DESCRIPTION OF DRAWINGS

Like reference numbers and designations in the various drawings indicate like elements.

DETAILED DESCRIPTION

Figure 1:
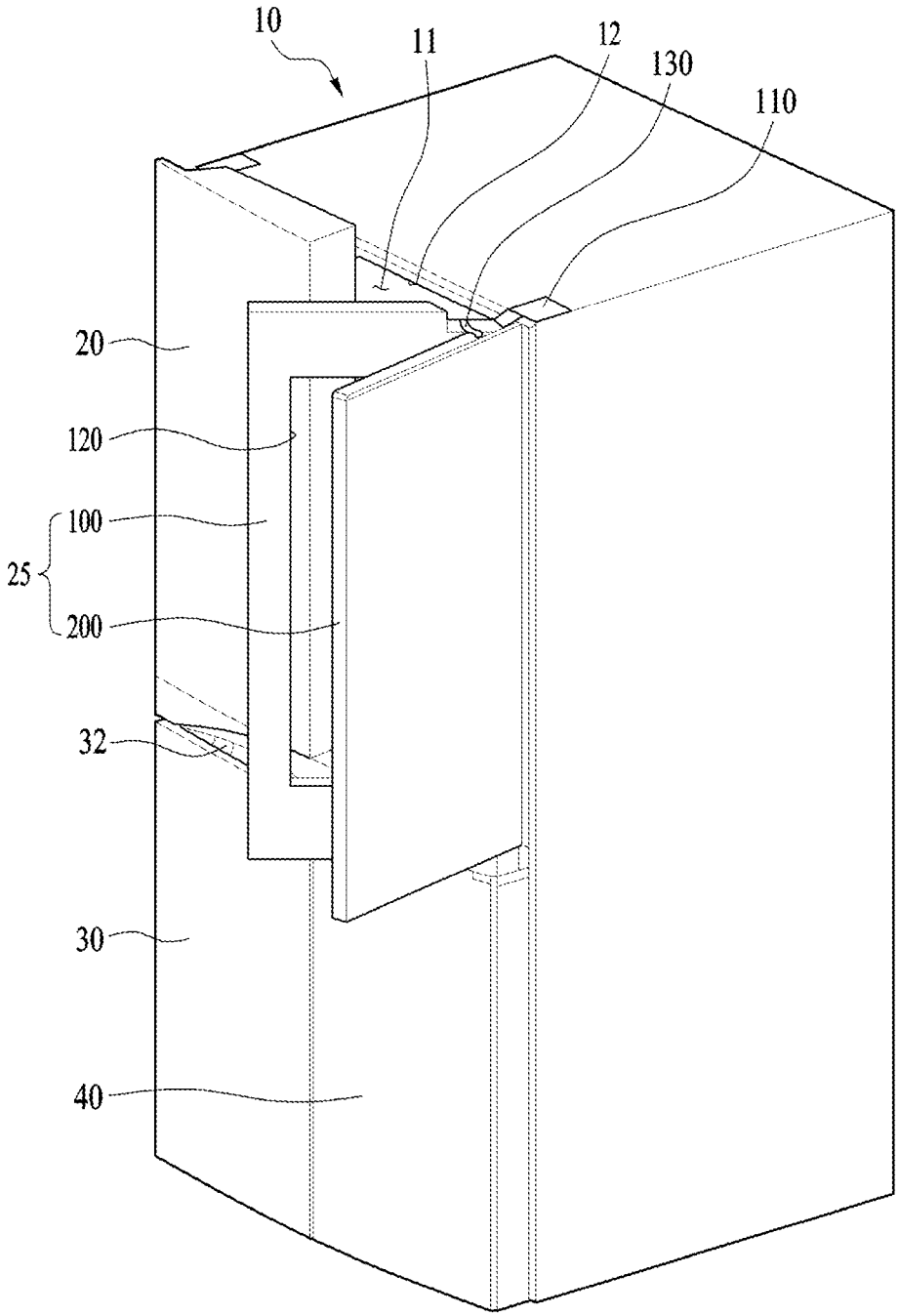
FIG. 1 is a diagram illustrating an example refrigerator.

FIG. 1 illustrates an example refrigerator.

In this example, the refrigerator is a bottom freezer type having a refrigerator compartment mounted in a top portion of a cabinet 10 and a freezer compartment mounted in a bottom portion of the cabinet. The refrigerator compartment and the freezer compartment may belong to a storage compartment or a main storage compartment 11 provided in the cabinet 10.

However, the refrigerator is not limited to the illustrated example. The refrigerator can be any type of a refrigerator. For example, the refrigerator can have a door rotatably coupled to a cabinet and opening/closing a storage compartment.

In the illustrated example, a left refrigerator door 20 and a right refrigerator door 25 as the door for opening/closing the refrigerator compartment may be rotatably coupled to left and right sides of the cabinet 10. Alternatively, one door may be rotatably coupled to the cabinet as the refrigerator door.

A freezer door provided under the refrigerator door may consist of a left freezer door 30 and a right freezer door 40 which are rotatably coupled to both lower sides of a front of the cabinet 10. Alternatively, one door may be rotatably coupled to the cabinet or a drawer type door is retractable as the freezer door.

A handle groove 32 may be provided in an n upper surface of the left freezer door 30 and another handle groove may be also provided in an upper surface of the right freezer door 40.

As shown in FIG. 1, the right freezer door 25 may include a main door 100 rotatably coupled to a predetermined portion of the cabinet 10; and a sub door 200 rotatably coupled to the main door 100 or the cabinet 10. In other words, a user can have access to the refrigerator compartment, when opening the main door 100 and the sub door 200 together.

An opening 120 may be provided in a central portion of the main door 100 and a sub storage compartment or a door basket may be provided in a rear portion of the main door 100. Accordingly, the opening 120 provided in the main door 100 may serve as a food introduction opening. The user can take out or put foods from or in the sub storage compartment through the food introduction opening 120 of the sub storage compartment. The sub door 200 may be configured to open and close the food introduction opening 120. The user can have access to the sub storage compartment or the door basket by opening only the sub door 200, even without opening the main door 100.

An opening 12 is also formed to the storage compartment 11, for example, the refrigerator compartment. In other words, a food introduction opening 12 is formed for the storage compartment. The user can take out or put foods from or in the storage compartment through the food introduction opening 12 of the storage compartment. The main door 100 may be configured to open and close the food introduction opening 12 of the storage compartment.

In some implementations, the refrigerator may include a moving basket mounted in the main door 100. The user can use the moving basket after opening only the sub door 200. In some implementations, the user can use the moving basket after opening the main door 100.

Figure 2:
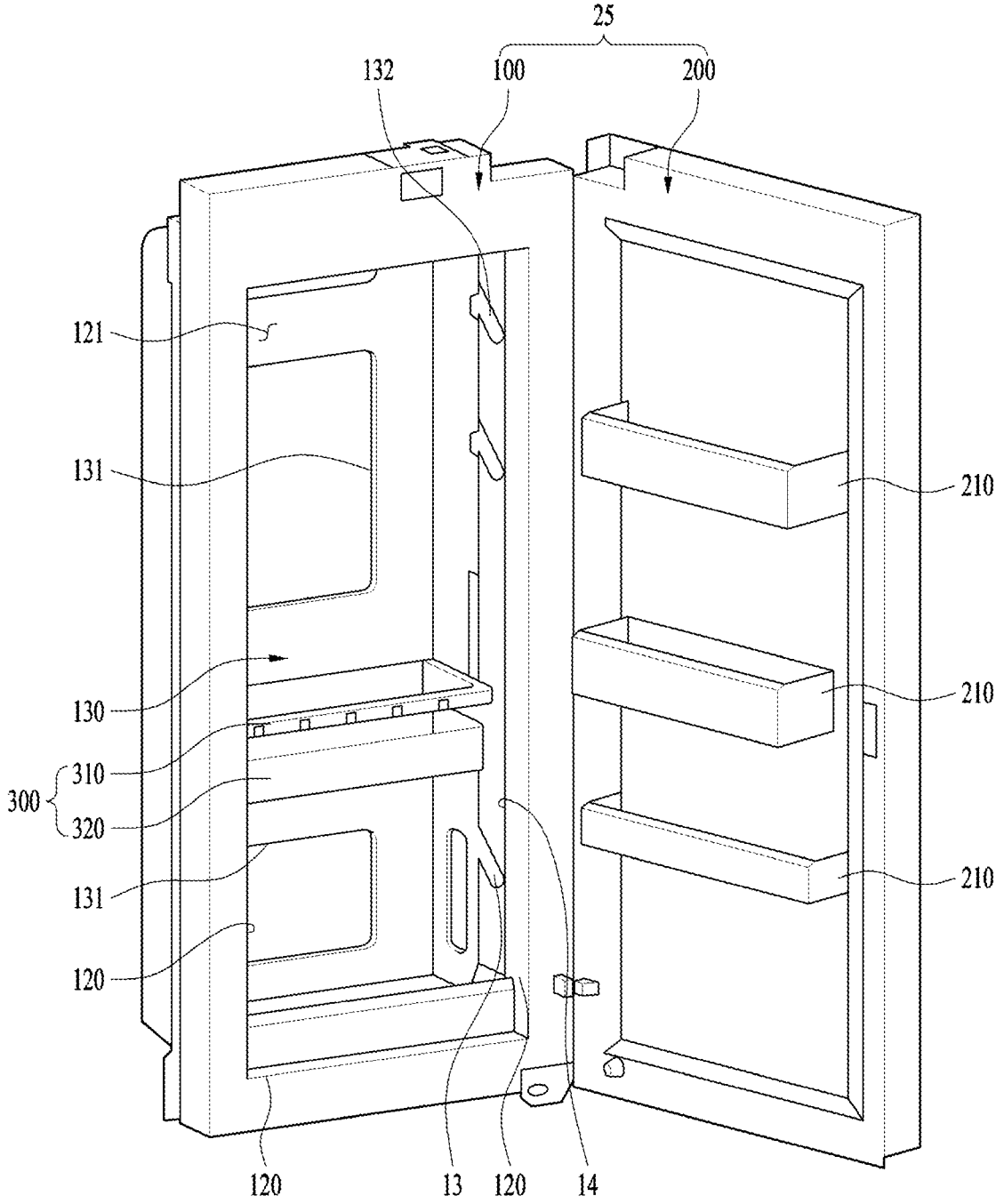
FIG. 2 is a diagram illustrating an example door of a refrigerator.

FIG. 2 illustrates an example door of a refrigerator.

A sub door basket 210 may be provided in a rear surface of the sub door 200. A plurality of sub door baskets 210 may be provided so that the user may use the baskets 210 as storage chambers after opening the sub door 200.

When the opening the sub door 200, the user can approach the sub storage compartment 121 through the food introduction opening 12 of the main door 100. Baskets may be also provided in the sub storage compartment 121 and a predetermined number of baskets may be provided along a vertical direction.

The baskets may include a fixed basket fixed to a vertical position and a moving basket having a variable vertical position. For example, the refrigerator can have at least one moving basket 300 provided in the sub storage compartment 121.

The baskets may be provided in a rear surface of the main door 100 and insertedly located in the storage compartment 11 as far as a preset distance. At least predetermined area of the sub storage compartment 121 is distant from the storage compartment 11.

FIG. 2 illustrates an example door of a refrigerator.

As shown in FIG. 2, a home bar case 130 may be provided to form the sub storage compartment 121. The home bar case 130 is coupled to the main door 100 to define a predetermined storage chamber. Also, the home bar case 130 includes an opening 131 for cold air communication with the storage compartment 11 so that cold air may be drawn into the sub storage compartment 121 from the storage compartment via the opening 121. A plurality of openings 131 may be formed in the home bar case 130, for example, several openings may be arranged along a vertical direction.

The home bar case 130 may be coupled to the main door 100 from a rear direction of the main door 100. For that, a predetermined number of coupling units 132 may be formed in an edge of the home bar case 130 and a corresponding number of coupling grooves 13 may be formed in the main door 100. The coupling unit 132 and the coupling grooves 13 may be inclined downward, so that the home bar case 130 can be fixedly coupled to the main door 100 by the self-load of the home bar case 130 as the coupling units 132 gets inserted in the coupling grooves 13. Rather than the coupling units 132 and the coupling grooves 13, other auxiliary types of coupling units may be provided to couple the home bar case 130 to the main door 100.

The moving basket 300 may be distant as far backward as a preset distance from the food introduction opening 120 of the sub storage compartment. That is to avoid the interference between the basket 210 of the sub door 200 and the moving basket 300, when the sub door 200 is closed.

The moving basket 300 may be coupled to the main door 100, more specifically, from a rear portion of the main door 100. Even when the home bar case 130 is provided, the moving basket 300 may be coupled to the main door 100 as being independent from the home base case 130 and the vertical position of the moving basket 300 is variable as being independent from the home bar case 130.

In some implementations, the width of the moving basket 300 is larger than that of the food introduction opening 120 of the sub storage compartment from side to side. That is, the area of the sub storage compartment is larger than that of the food introduction opening 120, which means that a rear wall 14 is formed in the food introduction hole 120. The rear wall 14 as a vertical surface may enlarge a right-and-left space inside the sub storage compartment 121 as much as the width of the rear wall 14.

When opens the sub door 20 in front of the refrigerator, the user can see the interior of the sub storage compartment via the food introduction opening 120 but not a rear wall of the food introduction hole 120. So, a rail (400, see FIG. 3) for supportively moving the moving basket 14 may be provided in the rear wall 14 which is invisible outside, only to minimize the visual exposure of the rail.

Figure 3:
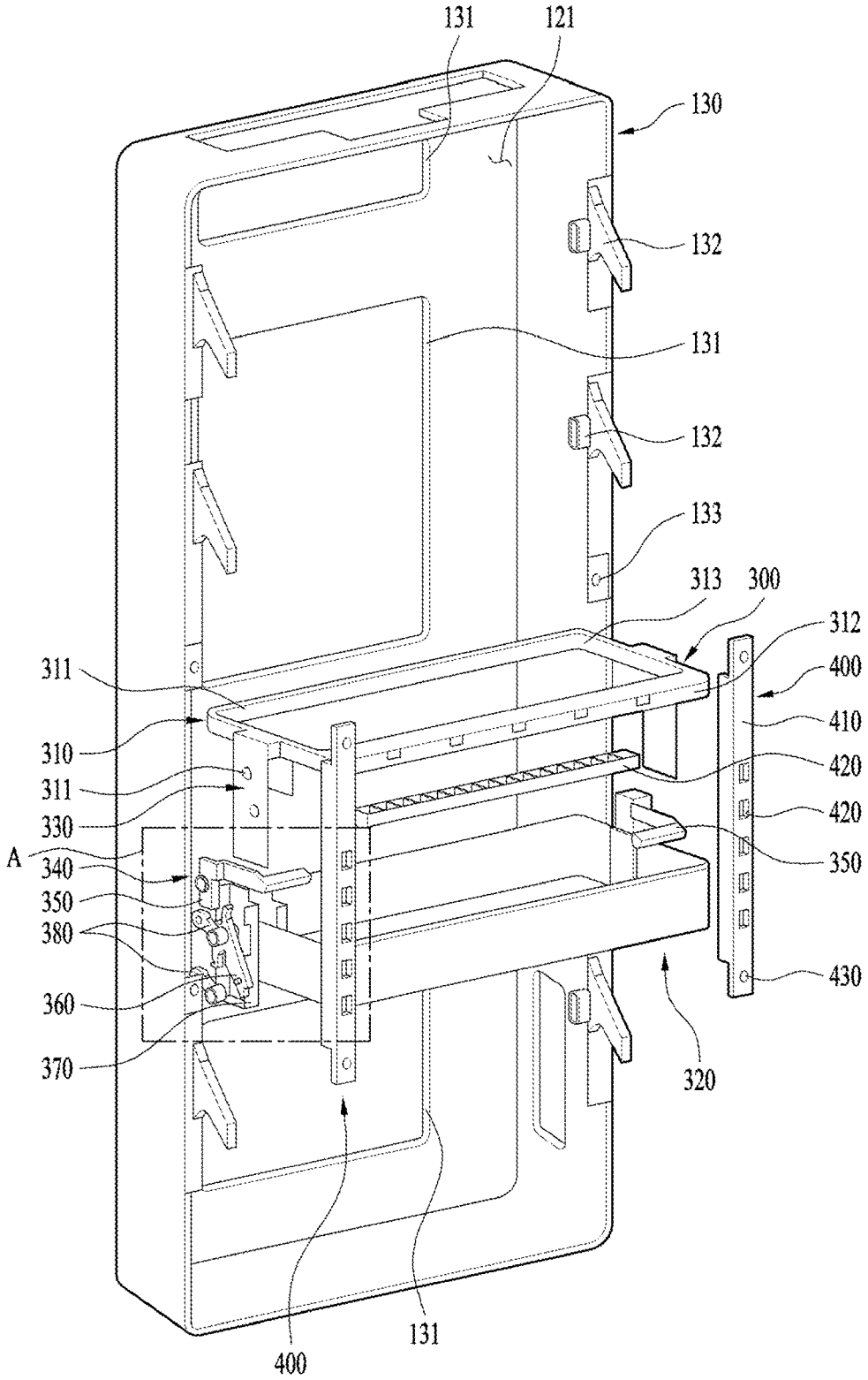
FIGS. 3 to 5 are diagrams illustrating an example home bar case and an example moving basket of a refrigerator.
Figure 4:
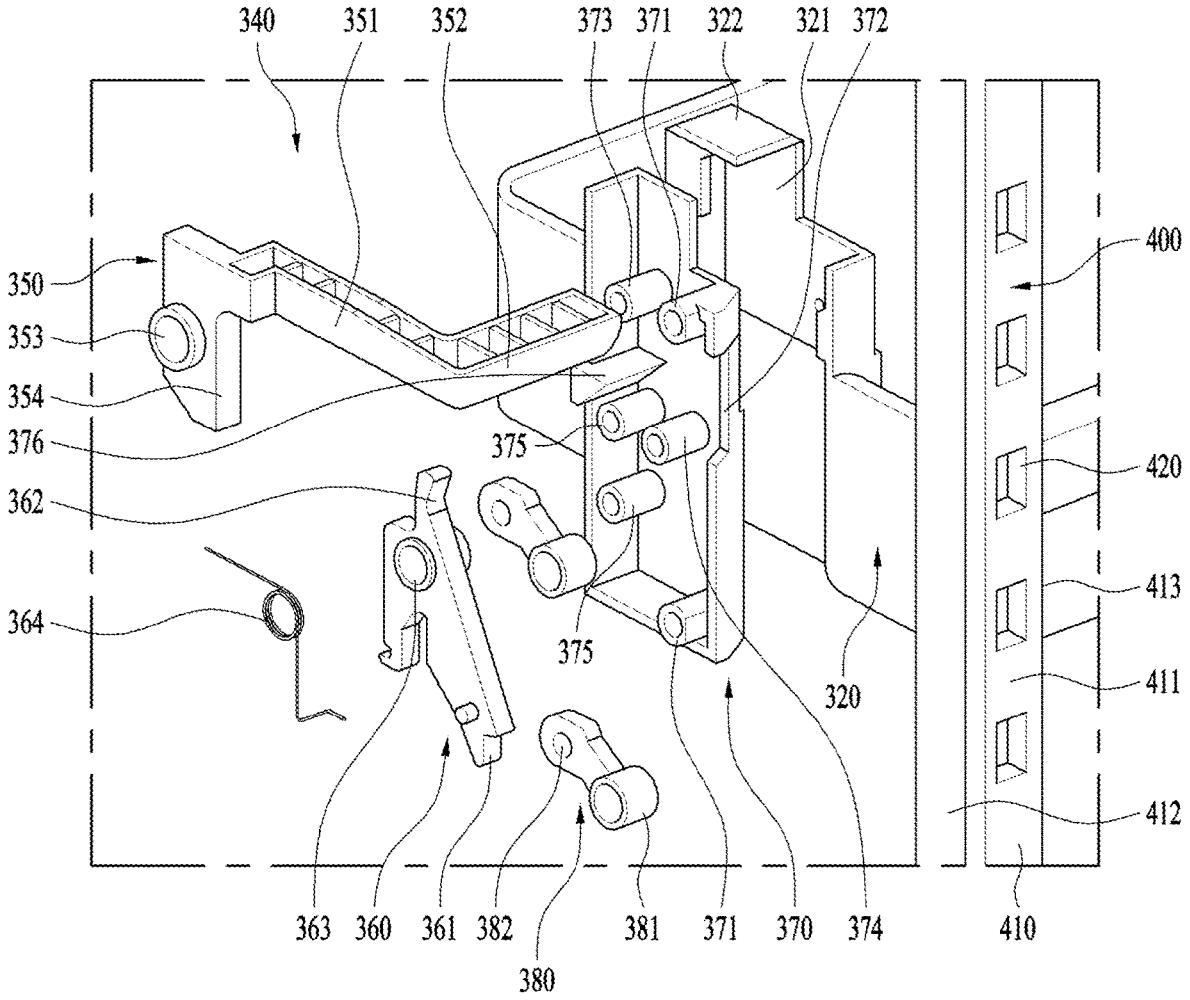
Figure 5:
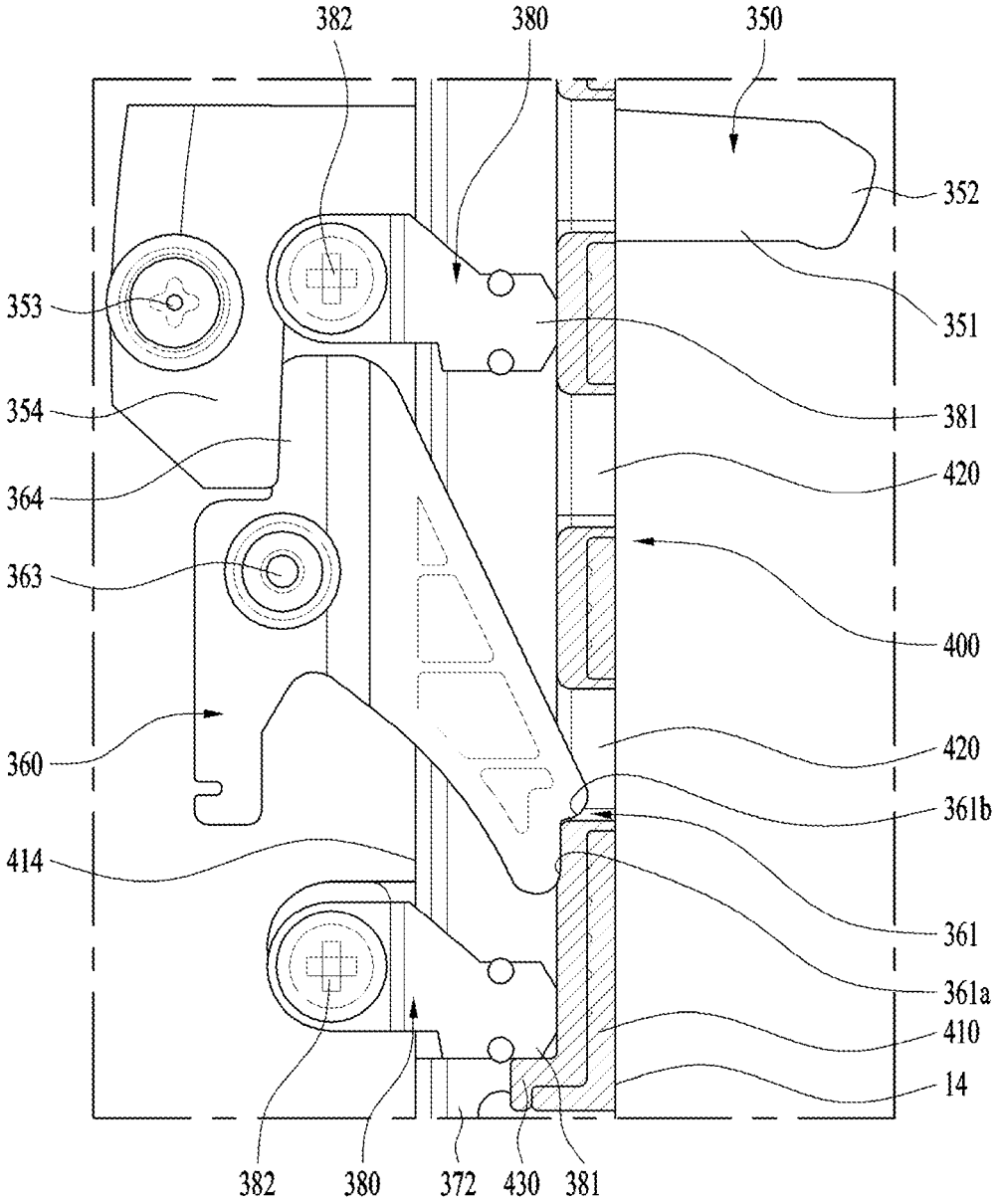

FIGS. 3 to 5 illustrate an example home bar case and an example moving basket of a refrigerator. FIGS. 4 and 5 illustrate the portion indicated as "A" in FIG. 2.

The moving basket 300 may include a moving frame 310 and a basket 320. The basket 320 may be formed in a container shape, more specifically, a rectangular-shaped container. The basket 320 may be provided in the sub storage compartment and made of plastic so as to be fabricated by injection molding.

The moving frame 310 is located beyond the basket 320. The moving frame 310 may be provided to support the overall load of the moving basket and then made of metal so as to realize the strong moving basket.

The moving frame 310 has a hole 313 and is formed in a corresponding shape to the basket 320. Like the rectangular-shaped basket 320, the moving frame 310 may be rectangular-shaped.

The user can put or take out foods in or from the moving basket 300 via the hole 313 of the moving frame 310. Accordingly, the height of the moving basket 300 is from the bottom to the moving frame 310, not the top of the basket 320.

More specifically, a bridge 330 may be provided to connect the basket 320 and the moving frame 310 with each other. The bridge 330 is provided to keep a vertical distance between them as well as connect them with each other. In addition, bridges 330 may be provided in right and left sides of the moving basket 300 so as to couple the basket and the moving frame to each other stably and keep the distance between them.

Figure 6:
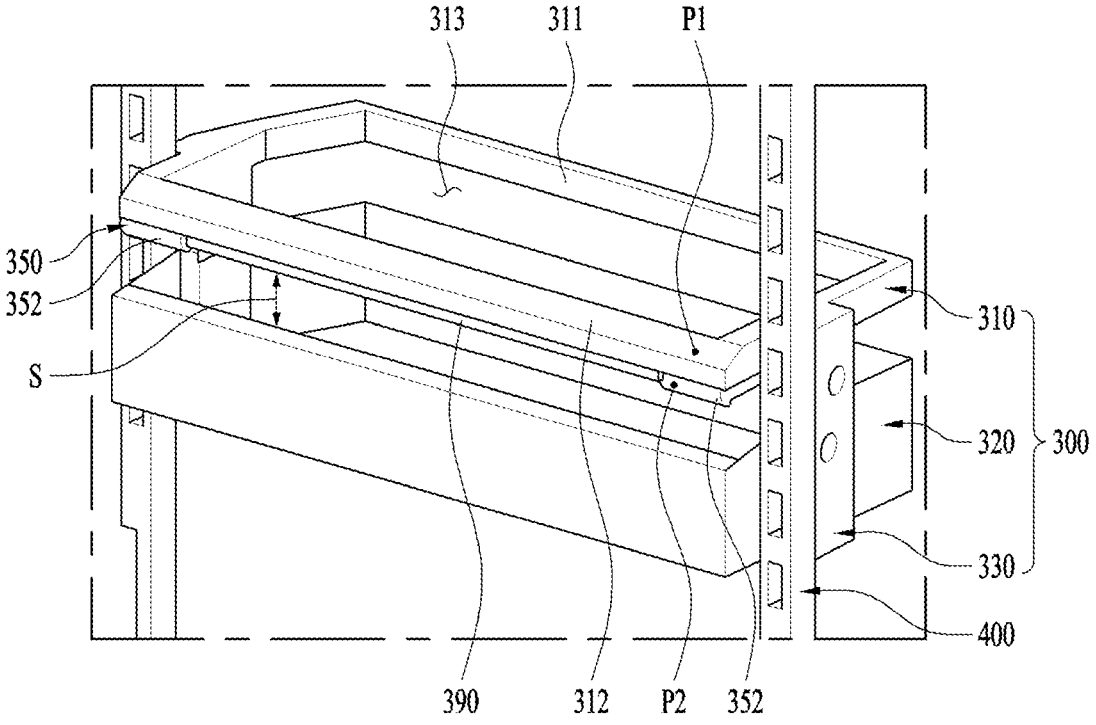
FIG. 6 is a diagram illustrating an example moving basket of a refrigerator.

Referring to FIG. 6, the bridges 330 form the distance or space between the moving frame 310 and the basket 320. Especially, the distance or space (S, see FIG. 6) is formed in a front portion of the moving basket 300 so that the foods stored in the moving basket 300, for example, certain parts of beverage containers may be visually exposed to the user via the space so that the user can identify the foods stored in the moving basket 300 easily. Also, the beverage containers having the same height may be stored in the moving basket 300 stably. The basket 320 is not formed to correspond to the overall height of the moving basket and it means that the height of the basket 320 can be decreased. It also means that the overall height of the moving basket can be increased by using the moving frame.

The bridge 330 may be extended from the moving frame 310 downward. In other words, the bridge 330 may be extended downward to be connected with the basket 320 located under the moving frame 310. It can be said that the bridge 330 may be configured to have a force applied thereto when the moving basket 300 moves vertically, which will be descried later. Accordingly, the bridge 330 may be made of metal like the moving frame.

The bridge may be integrally formed with the moving frame 310. The moving frame 310 and the bridge 330 may be fabricated by aluminum die casting or made of stainless steel.

The rail 400 may be provided to support the moving basket 300 and guide the vertical motion of the moving basket 300. As mentioned above, the rails 400 may be provided in both sides of the moving basket 300, respectively, and fixed to the rear wall 14 of the main door 100 so that the rails 400 may be hidden and not to be visually exposed through the opening 120 from an exterior area of the cabinet.

The rail 400 may include a rail body 410 vertically extended and guiding the vertical motion of the moving basket; and a plurality of rail holes 420 for specifying locations of the moving basket. The rail holes 420 may be arranged in a vertical line and the number of the rail holes 420 may be the number of variable positions of the moving basket.

As shown in FIG. 5, a rail stopper 430 may be formed in a lower end of the rail body 410. The rail stopper 430 may be formed in a corresponding position to the lowest position of the moving basket 300. Accordingly, the lowermost one of the supporting units 380 is configured to face the rail stopper 430 to stop the moving basket 300 from moving any farther downward.

Securing portions 430 may be provided in upper and lower ends of the rail body 410, respectively, as securing holes, so that the rail 400 may be stably secured to the main door 100 through the securing portions 430. In other words, the rail 400 may be stably secured to the rear wall 14 of the opening 120 provided in the main door 100.

The rail body 410 may be formed as channel and an opening 414 may be formed in the rail body 410. For example, the rail body 410 consists of a left lateral surface 412, a right lateral surface 413 and a front surface 411. The front surface 411 closely contacts with the rear wall 14 to secure the rail body to the rear wall 14. A rail hole 420 may be formed in the front surface 411 and the opening 414 may be formed between the left lateral surface 412 and the right lateral surface 413. The opening 414 is open toward the back side of the refrigerator. At least predetermined portions of the supporter 380 and the stopper 360 may be inserted in the rail via the opening 414 of the rail body, in other words, from a rear portion to the front portion of the rail.

The moving basket 300 may include a support assembly 340 provided to supportively move the moving basket along the rail 400. The support assembly 340 may be provided in each of right and left sides of the moving basket 300.

More specifically, the support assembly 340 may include the supporting unit 380. The support may be projected from the bridge 330 toward the rail 400 and support the moving basket 300 with respect to the rail 400. Accordingly, a plurality of supporting units 380 may be provided in a vertical direction to support the moving basket more stably. For example, two supporting units 380 may be provided in a vertical line so to form two left vertical supporting points and right vertical supporting points in the moving basket 300. Accordingly, the moving basket 300 may be supported stably at the four supporting points and the vertical supporting points stably support the moving basket 300, especially, the vertical load of the moving basket 300. As it will appear hereafter, the stopper 360 also supports the moving basket 300 and the moving basket 300 may have three left vertical supporting points and three right vertical supporting points.

The support assembly 340 may include a lever 350. The lever 350 can be moved by the user's manipulation. The user presses and manipulates the lever 350 to have displacement and move the moving basket 300 vertically. In other words, the user can move the moving basket 300 upward or downward in a state of pressing the lever 350.

The support assembly 340 may include a stopper 370. The stopper may become selectively hooked to the rail 400 by the user's manipulation of the lever 350. In other words, the state where the stopper 370 is hooked to the rail 400 may mean a state where the moving basket 300 is secured. The state where the stopper 370 is released from the rail 400 may mean a state where the moving basket 300 is vertically movable.

As mentioned above, the plurality of the rail holes 420 may be provided in the rail 400 and the stopper 370 is provided to be selectively inserted in the rail holes 420. When inserted in one of the rail holes 420, the stopper 370 is hooked to the rail 400 and the moving basket 300 is then secured at the position. When the stopper 370 is released from the rail hole 420, the moving basket 300 is movable upward or downward.

The stopper 370 also has displacement like the lever 350. Such displacement of the stopper 370 is generated by the displacement of the lever 350. Accordingly, when the displacement of the lever 350 is generated by the user's manipulation of the lever 350, the displacement of the lever 350 is converted into the displacement of the stopper 370.

For example, in case the lever 350 is pressed and manipulated to have a counter-clockwise rotation displacement by the user, the counter-clockwise rotation displacement may be converted into a clockwise rotation displacement of the stopper 360. Accordingly, the stopper 360 may be selectively hooked to the rail 400 by the user's manipulation of the lever 350.

In some implementations, the sub storage compartment 121 may be formed by using the moving basket or other baskets. For example, baskets may be provided over and/or under the moving basket 300. Such baskets may be the fixed baskets having fixed vertical positions.

However, the home case 130 may be provided to partition off the sub storage compartment 121 from the storage compartment 11. Accordingly, the home bar case 130 may be coupled to the rear surface of the main door 100 in a state of partially accommodating the moving basket 300. At this time, the home bar case may be coupled to the main door by using a coupling hole 133 formed in the home bar case 130 as well as the coupling units 132 and the coupling grooves 13 mentioned above.

In addition, basket securing portions 132 may be formed in right and left sides of the home bar case 130 to secure the fixed baskets thereto. The plurality of the basket securing portions 132 may be formed in the vertical direction according to the number of the baskets.

Hereinafter, the support assembly 340 will be described in detail.

The lever 350 may include a press portion 352 and a rotation shaft 353. When the user presses or pulls the press portion 352, the lever 350 may rotate on the rotation shaft 353. In case the user manipulates the press portion, an upward and downward linear displacement of the press portion 352 is generated, viewing only a lateral surface of the press portion 352. That is because a rotation allowable angle of the lever 350 rotatable by the user's manipulation of the press portion is relatively small.

A coupling boss 373 having the same axis as the rotation shaft may be provided to rotatably fix the lever 350. More specifically, the rotation shaft 353 of the lever 350 is insertedly coupled to the coupling boss 373 and the lever 350 is rotatably fixed.

In some implementations, the press portion 352 is located inside with respect to a radial direction of the food introduction opening 120 to facilitate the user's convenient manipulation and that the rotation shaft 353 of the lever is located in a rear portion of the rear wall 14 not to be visually exposed to the user. In some implementations, the lever 350 includes an extended portion 351 for connecting the shaft 353 and the press portion 352 with each other.

The extended portion 351 may be extended from the rotation shaft 353 forward. In other words, the extended portion 351 may be extended forward from the rear portion of the rear wall 14. Accordingly, the extended portion 351 is not visually exposed.

The press portion 352 may be horizontally extended from an end of the extended portion along an inner radial direction of the food introduction opening 120. The press portion provided in a left side of the moving basket 300 is extended rightward and the press portion provided in the right side of the moving basket 300 is extended leftward. Accordingly, the user can reach the press portion 352 via the food introduction opening 120.

In addition, the lever 350 may include a displacement transfer portion 354, in other words, the displacement transfer portion 354 for transferring the displacement generated in the press portion 352 to the stopper 360.

The stopper 360 may include a raised stop formed in an area adjacent to the rotation shaft 363; and a displacement accommodating portion 362 formed in the other area. The displacement accommodating portion 362 is arranged to face the displacement transfer portion 354 of the lever 350. To rotatably secure the stopper 360, a securing boss 374 having the same axis as the rotation shaft 363 of the stopper 360 may be provided. More specifically, when the rotation shaft 363 of the stopper 360 is insertedly coupled to the securing boss 343, the stopper 360 may be rotatably secured.

The raised spot 361 may be formed to be coupled to the rail hole 420 of the rail 400. A vertical surface 361*a* of the raised spot is provided to limit the inserted length in the rail hole 420 and a horizontal surface 361*b* is insertedly coupled to the rail hole 420. Once the raised spot is insertedly coupled to the rail hole 420, the downward movement of the stopper is limited and that means that the position of the moving basket 300 is secured. The moving basket 300 is basically configured to receive the vertical load and the downward movement of the moving basket 300 is limited as the raised spot 361 is insertedly coupled to the rail hole 420.

The rotation shaft 363 of the stopper 360 and the rotation shaft 353 of the lever 350 are eccentric. When the lever 350 rotates in a counter-clockwise direction, the stopper 360 rotates in a clockwise direction.

In some implementations, a bracket 370 is provided to rotatably secure the stopper 360 and the lever 350. In some implementations, the bracket 370 is provided to connect the bridge 330 and the basket 320 with each other. The bracket 370 is coupled to the basket 320 and the bridge is coupled to the bracket 370.

In some implementations, the securing boss 373 and 374 provided to rotatably secure the shaft 363 of the stopper and the shaft 353 of the lever may be formed in the bracket 370. Accordingly, it can be said that the stopper 360 and the lever 350 are rotatably secured to the bracket 370. In some implementations, the bracket 370 provided as an independent member is fixed to the basket 320. The securing boss and the bracket 320 can be integral part.

As mentioned above, the lever 350 has the displacement generated by the user's manipulation. In some implementations, the lever 350 has the allowable maximum displacement. To prevent the lever 350 from moving beyond the maximum displacement, a lever stopper 376 may be further provided to limit the displacement of the lever 350 and the lever 350 can face the lever stopper 376 at the maximum displacement, only to generate no more displacement.

The lever stopper 376 may be also formed in the bracket 370. In some implementations, the lever stopper 376 can limit the maximum displacement of the stopper 360. In some other implementations, other configurations such as the moving frame 310 and the basket 320 can limit the maximum displacement of the lever 350 or the stopper 360.

The bracket 370 is configured to support the load of the moving basket 300 consistently. In some implementations, the bracket 370 is structured to stably support the load of the moving basket 300. For that, a bracket accommodating portion 321 may be formed in the basket 320. At least predetermined area of the bracket is accommodated by the bracket accommodating portion 321 to couple the bracket to the bracket accommodating portion. Accordingly, the coupling area between them may be increased.

The bracket accommodating portion 321 may include a bracket cover 322 for covering a top of the bracket 370 and the bracket cover 322 may be configured to protect the components arranged in the bracket and prevent the visual exposure of the internal components. Also, the bracket accommodating portion may be integrally formed with the basket 320, in other words, they may be integrally formed by plastic injection molding. The load of the bracket 320 may be transferred to the bracket 370 by the bracket cover 322. As the bracket 370 is stably secured to the rail 400 by the supporter 380 and the stopper 360, the moving basket 300 may be strongly secured to the rail 400 accordingly. Even when relatively heavy foods are stored in the basket 320, the moving basket 300 may be secured stably. The vertical position of the moving basket 300 can be easily adjusted.

In some implementations, a bridge coupling portion 375 may be formed in the bracket 370. The bridge coupling portion 375 may be also formed in a coupling boss shape. Corresponding to the bridge coupling portion 375, a coupling hole 331 may be formed in the bridge 330 and the bridge 330 may be stably secured to the bracket 370 by the bridge coupling portion 375 and the coupling hole 331. In this instance, as the bracket 370 is stably secured to the basket 320, the entire configurations of the moving basket 300 including the moving frame 310, the bridge 330, the bracket 370 and the basket 320 may be stably secured to each other.

The bridge 370 may be formed as a plate vertically extended in a downward direction. The plate shape may be a plate with a narrow rightward-and-leftward width and a long forward-and-backward width. The bridge 370 may be coupled to the bracket 370 after the lever 350, the stopper 360 and the supporting unit 380 are coupled to the bracket 370.

The bracket 370 may partially accommodate the lever 350, the stopper 360 and the supporting unit 380. As coupled to the bracket 370, the bridge 370 covers those components. More specifically, the bridge 370 covers them in a lateral direction and it can be said that the bridge functions as a lateral cover.

The component such as the lever 350 or the stopper 360 is configured to have a displacement within the bracket and those components may be protected by the bridge 370. In other words, foreign substances may be prevented from permeating into and getting stuck on the bracket so that the user can move the moving basket easily if necessary, even if the moving basket is being used for a long time.

As mentioned above, the user manipulates the lever 350 only to have a displacement. The stopper 360 has a displacement through communication with the operation of the lever 350. Such the user's manipulation is performed to move the moving basket 300 upward and downward. Once the manipulation is complete, the lever 350 and the stopper 360 may restitute. For that, in some implementations, a spring 364 is provided in at least one of the lever 350 and the stopper 360. More specifically, the spring may be provided to restitute the support 360. In case only the lever 350 restitutes, the support 360 might fail to return to its original position.

The user manipulates the lever 350 while overcoming the elasticity of the spring 364. Once the manipulation of the lever 350 is complete, the lever 350 and the support 360 can go back to their original positions by the elastic restoring force of the spring 364. In this instance, the original position of the support 360 means the position at which the support is hooked to the rail 400 and the original position of the lever 350 means the position before the displacement is generated.

The user can move the moving basket upwardly or downwardly to locate the moving basket at a desired position by manipulating the lever 350. In some implementations, the levers 350 can be respectively provided in right and left sides of the basket. In this instance, the user manipulates the right and left levers 350 to move the moving basket vertically. The user can manipulate the levers 350 using two hands.

In some other implementations, a lever connection portion 390 can be provided to make both levers 350 to be coupled each other. Thus, a user can move the moving basket using one hand. The lever connection portion 390 may be connected to both of the right and left levers so that the manipulation of the lever connection portion may result in the manipulation of the right and left levers.

Figure 7:
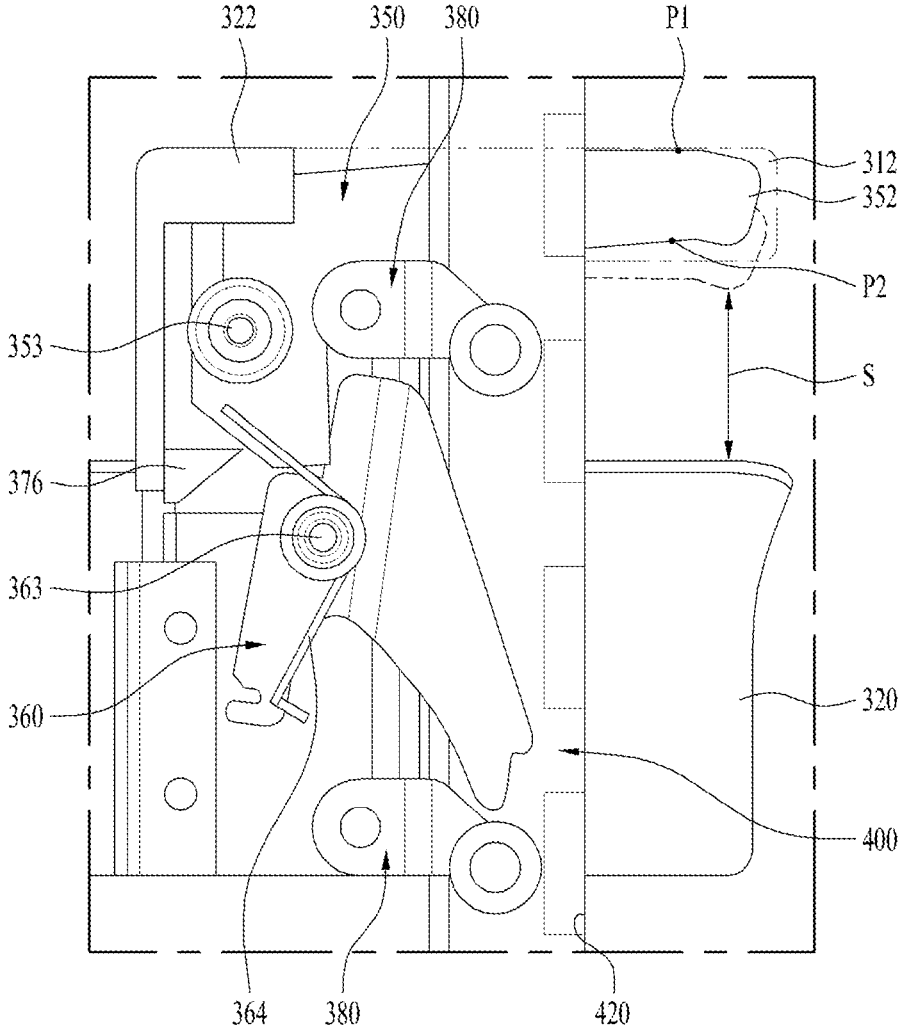
FIG. 7 is a diagram illustrating an example support assembly of the moving basket in FIG. 6.

FIG. 6 illustrates an example moving basket of a refrigerator. FIG. 7 illustrates an example support assembly of the moving basket in FIG. 6.

The moving basket 300 includes the moving frame 310, the basket 320 and the bridge 330 so that the space (S) may be formed between the moving frame 310 and the basket 320. Such the space (S) may be located in the front portion of the moving basket 300. The space (S) may form certain space in which the user's hand can be inserted and through which the user can see the internal space of the moving basket 300.

The user manipulates the lever 350 to move the moving basket 300 upward and downward. In this instance, the position of the lever 350, especially, the press portion 352 and the relation with the other components are very important, because the design might be degraded by the press portion 352 or interference might occur when the user is moving foods.

In this example, the support assembly 340 is basically covered by the bridge 330. However, a predetermined part, in other words, the press portion 352 of the lever 350 provided in the support assembly 340 may be extended to an inner portion of the food introduction opening 120 in a radial direction.

In some implementations, at least predetermined portion of the lever 350 is accommodated by the moving frame 310. Especially, the portion of the lever may be accommodated by a front moving frame 312. The front moving frame 312 formed in a channel shape, with an opening formed in the bottom, and the lever 350 can be inserted in the opening.

As shown in FIG. 7, a front end of the lever 350 may be located behind a front end of the moving frame 310. The front end of the lever 350 may be located behind a front end of the basket 320. In this instance, an alternated long and short dash line shows the front moving frame 312 and a dotted line shows the press portion 352 before being pressed.

Accordingly, at least a portion of the lever 350 is covered by the moving frame 310, i.e., it is possible to realize the hidden press portion 352. Even if the lever connection portion 390 is provided, it is also possible to realize a hidden lever connection portion 390 and then the beautiful design and protect both the press portion 352 and the lever connection portion 390. Especially, the other configuration of the moving basket 300 may have the same appearance as the fixed basket, except the press portion or the lever connection portion 390. Accordingly, the design unity of the baskets for the baskets may be realized. As they are located in the lower portion and rear portion of the moving frame 310, the exposure of the press portion and the lever connection portion 390 may be minimized.

In this example, the user can manipulate the press portion 352, the support, and the moving basket 300 at the same time. More specifically, the user may hold points of P1 and P2 simultaneously and then perform the downward motion and the upward motion of the moving basket 300 easily because the user can apply a force to a desired direction for upward or downward movement, using the moving frame 310 supporting the load of the moving basket 300. Such usage may be facilitated by the space (S), because the user can insert the hand via the space (S). Accordingly, even when relatively heavy foods are stored in the moving basket 300, the user can move the moving basket in hands easily.

In this example, the user can hold the front moving frame 312 in both hands, which is facilitated by the opening 313 of the moving frame 310 and the space (S). While supporting the load of the moving basket in a state of holding the front moving frame 312, the user may press the press portion with a finger. Accordingly, the vertical motion of the moving basket 300 may be performed smoothly and more stably.

Figure 8:
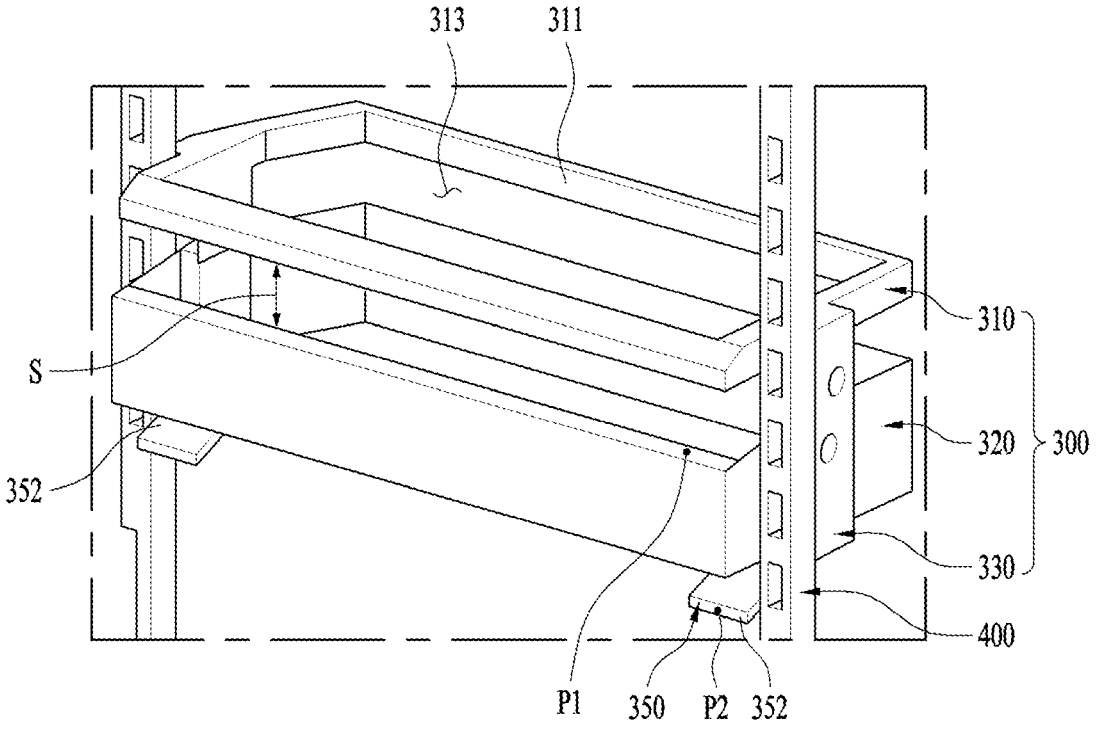
FIG. 8 is a diagram m illustrating another example moving basket of a refrigerator.
Figure 9:
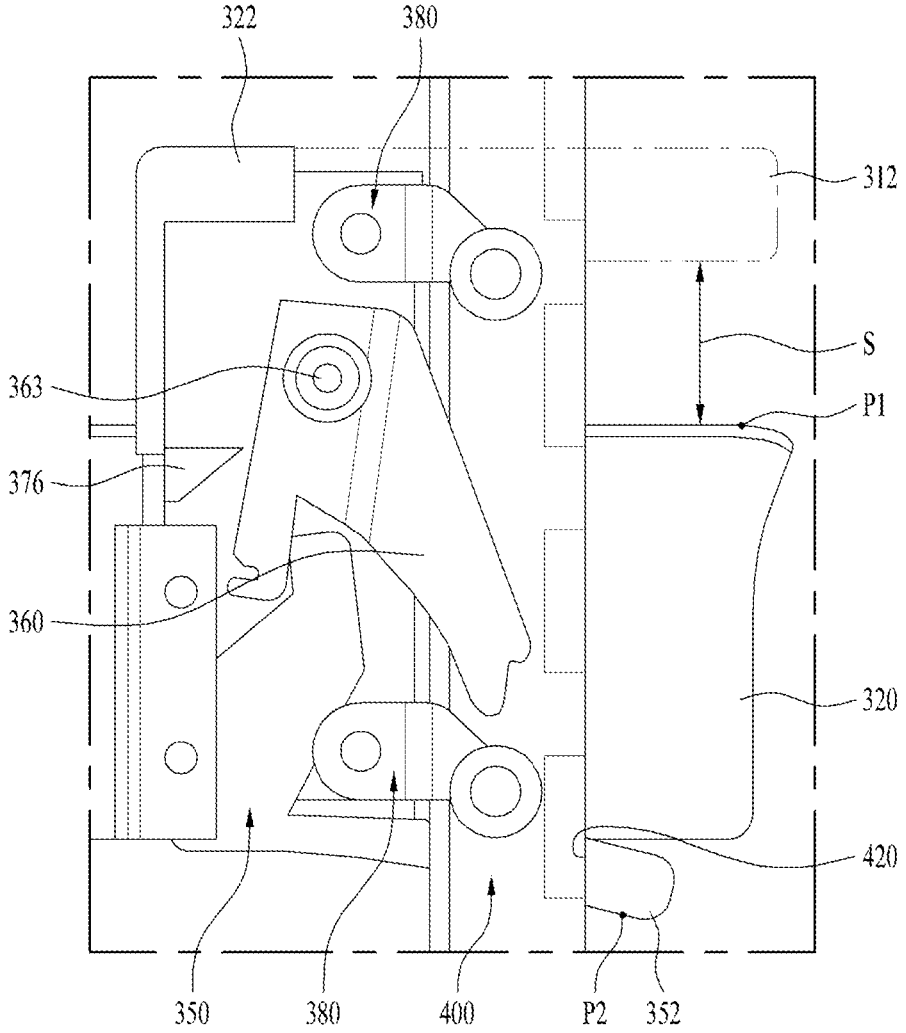
FIG. 9 is a diagram illustrating an example support assembly of the moving basket in FIG. 8.

FIG. 8 illustrates another example moving basket of a refrigerator. FIG. 9 illustrates an example support assembly of the moving basket in FIG. 8.

The moving basket 300 includes the moving frame 310, the basket 320 and the bridge 330 so that the space (S) may be formed between the moving frame 310 and the basket 320. Such the space (S) may be located in the front portion of the moving basket 300. The space (S) may form certain space in which the user's hand can be inserted and through which the user can see the internal space of the moving basket 300.

The user manipulates the lever 350 to move the moving basket 300 upward and downward. In this instance, the position of the lever 350, especially, the position of the press portion 352 can be determined to avoid interference between the press portion 352 and other parts.

In this example, the support assembly 340 is basically covered by the bridge 330. However, a particular part such as the press portion 352 of the lever 350 provided in the support assembly 340 may be extended to an inner portion of the food introduction opening 120 in a radial direction.

In some implementations, the lever 350 is located under the basket 352. As shown in FIG. 9, a front end of the lever 350 may be located farther behind a front end of the basket 320.

Accordingly, at least a portion of the lever 350 is covered by the moving basket 320, i.e., it is possible to realize the hidden press portion 352. Even if the lever connection portion 390 is provided, it is also possible to realize a hidden lever connection portion 390 and protect both the press portion 352 and the lever connection portion 390. Especially, the other configuration of the moving basket 300 may have the same appearance as the fixed basket, except the press portion or the lever connection portion 390. Accordingly, the design unity of the baskets for the baskets may be realized. As they are located in the lower portion and rear portion of the moving frame 310, the exposure of the press portion and the lever connection portion 390 may be minimized.

In this example, the user can manipulate the press portion 352 and the support the moving basket 300 at the same time. More specifically, the user may hold points of P1 and P2 simultaneously and then perform the downward motion and the upward motion of the basket 320 easily. In this instance, P1 is located in an upper portion of the basket 320 and P2 is located in a lower portion of the basket 320.

As mentioned above, the height of the basket 320 with respect to the overall height of the moving basket 300 may be reduced. The user can insert the hand in the space (S) via the space (S). That means that the user can hold P1 and P2 in one hand simultaneously, considering the average size of an adult's hand. In other words, the height of the basket 320 may be determined in consideration of the average size of the adult's hand.

Accordingly, the user can move the moving basket 300 upward and downward smoothly, because he or she can apply the force to a desired direction, in other words, upward or downward to move the moving basket by using only the basket 320. For example, the user is allowed to hold P1 with the thumb and P2 with the other fingers, and vice versa. Even when relatively heavy foods are put in the moving basket 300, the user can move the moving basket easily, using both hands.

In some implementations, the overall height of the basket can be adjusted to allow a user to hold the upper and the lower portions of the basket in one hand. In some other implementations, the moving frame 310 can be spaced at a preset distance apart from the top of the basket so that the overall height of the moving basket can be determined optimally based on the foods or containers which are used often.

In this example, the appearance or location of the lever 350 can be different from that of the lever 350 in the example described with reference to FIGS. 6 and 7. In this instance, the shape of the stopper 360 corresponding to the lever 350 can be changed. However, other structures of the lever 350 in this example can be the same or similar to the lever 350 of the example described with reference to FIGS. 6 and 7. For example, the stopper 360 can be removed by the user's manipulation of the lever 350. In addition, the supporting unit 380, the moving frame 310 and the basket 320 of the example described with reference to FIGS. 6 and 7 can be applied to this example.

Figure 10:
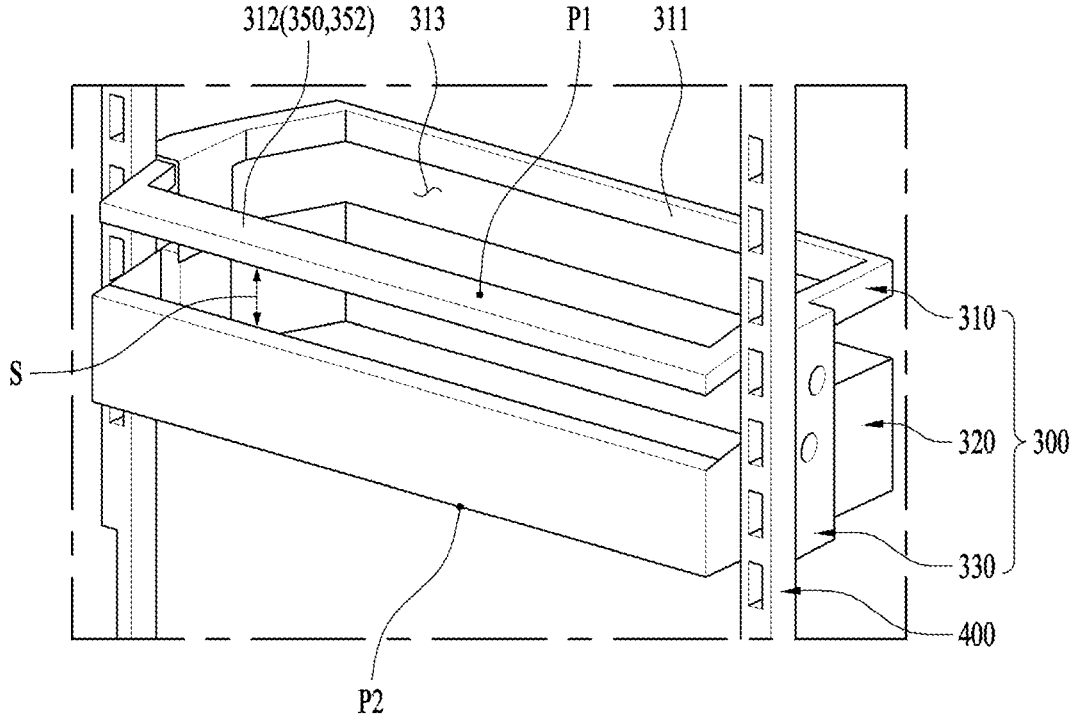
FIG. 10 is a diagram illustrating another example moving basket of a refrigerator.
Figure 11:
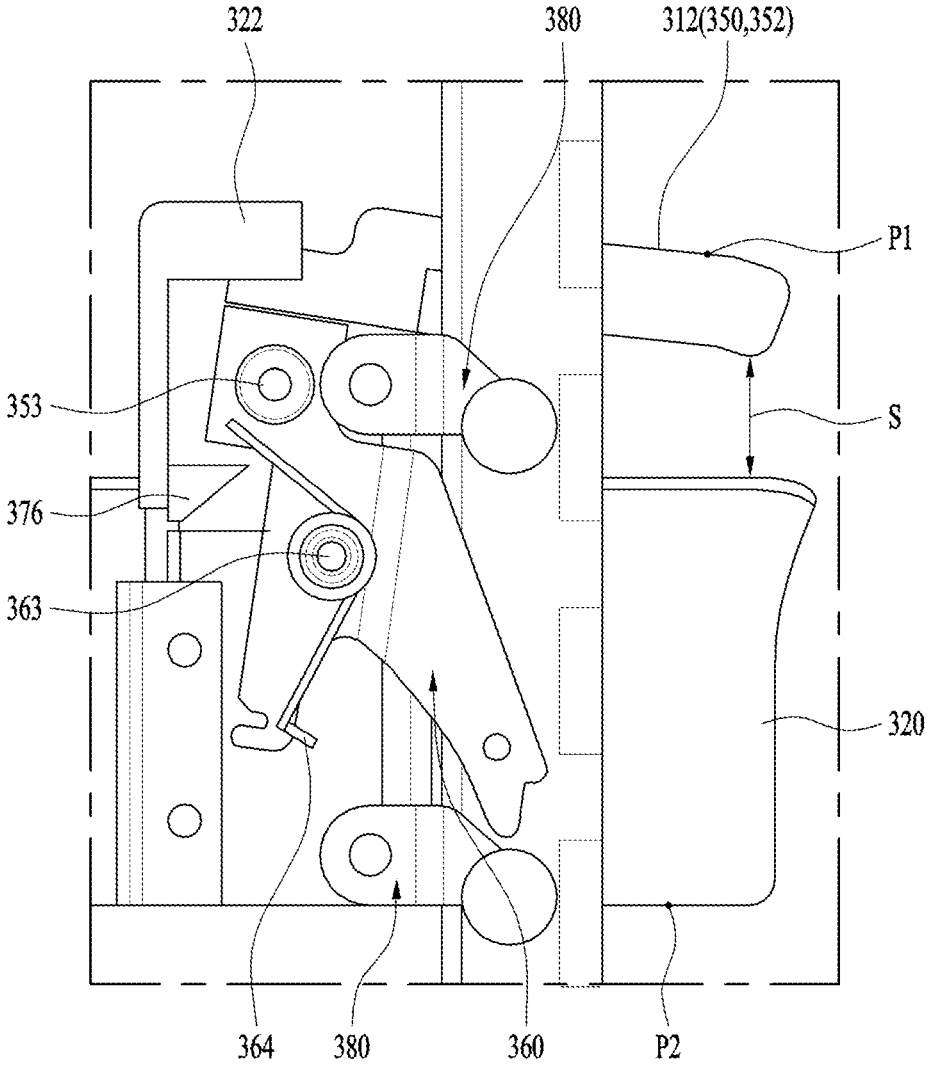
FIG. 11 is a diagram illustrating an example support assembly of the moving basket in FIG. 10.

FIG. 10 illustrates another example moving basket of a refrigerator. FIG. 11 illustrates an example support assembly of the moving basket in FIG. 10

The moving basket 300 includes the moving frame 310, the basket 320 and the bridge 330 so that the space (S) may be formed between the moving frame 310 and the basket 320. Such the space (S) may be located in the front portion of the moving basket 300. The space (S) may form certain space in which the user's hand can be inserted and through which the user can see the internal space of the moving basket 300.

The user manipulates the lever 350 to move the moving basket 300 upward and downward. In this instance, the position of the lever 350, especially, the press portion 352 and the relation with the other components are very important, because the design might be degraded by the press portion 352 or interference might occur when the user is moving foods.

In this example, the support assembly 340 is basically covered by the bridge 330. However, a predetermined part, in other words, the press portion 352 of the lever 350 provided in the support assembly 340 may be extended to an inner portion of the food introduction opening 120 in a radial direction.

The lever 350 may be formed as the moving frame 310, especially, the front moving frame 312. In other words, the lever 350 may replace the front moving frame 312. Specifically, the press portion 352 of the lever 350 may replace the front moving frame 312. Accordingly, such the front moving frame 312 is movable by the user's pressing and it functions as the front moving frame 312 in ordinary times.

As shown in FIG. 11, the front moving frame 312 itself functions as the press portion 352 so that the press portion 352 needs not be hidden in consideration of the design. When the front moving frame 312 and the rear frame 311 are made of the same material, the rear frame may have the same design as the moving frame.

Especially, the other configuration of the moving basket 300 may have the same appearance as the fixed basket, except that the front moving frame 312 is configured to have a displacement. Accordingly, the design unity of the baskets for the baskets may be realized. As they are located in the lower portion and rear portion of the moving frame 310, the exposure of the press portion and the lever connection portion 390 may be minimized.

In some implementations, the user can manipulate the press portion 352 and the support the moving basket 300 simultaneously. In particular, the user can hold points of P1 and P2 simultaneously. The user can press P1 located in an upper portion of the front moving frame 312 in one hand and support P2 located in a lower portion of the basket 320 in the other hand. Accordingly, the user can move the moving basket 300 upward and downward smoothly, because he or she is holding the upper and lower portion of the moving basket 300 simultaneously. Accordingly, the user can apply the force to a desired direction, in other words, upward or downward.

The space (S) facilitates such usage, because the space (S) facilitates the downward movement of the front moving frame 312. In this instance, the space (S) has the maximum height at the original position. The space (S) has the minimum height when the front moving frame 312 is pressed to move the moving basket.

In this example, P1 and P2 can be adjusted based on hand sizes of a user. However, the user can intuitionally recognize P1 and an optimal P2 which are optimal to balance the weight.

What is claimed is:

1. A refrigerator comprising:

a cabinet that includes a storage compartment and an opening to the storage compartment;

a first door that is configured to cover the opening to the storage compartment and that includes a first compartment and a first opening to the first compartment;

a second door that is configured to cover the first opening to the first compartment and that is coupled to the first door;

a moving basket that includes:

a basket that is located inside the first compartment, a moving frame arranged above the basket, the moving frame including a second opening through which an object passes to be stored in the basket, wherein a third opening is defined between the moving frame and the basket, and a bridge that couples the basket to the moving frame;

a rail that is coupled to the first door and that is configured to guide the moving basket;

a supporting unit that is projected from the bridge toward the rail and that supports the moving basket;

a lever that is located at a lower portion of the basket and that is configured to, based on manipulation by a user, move between a first position and a second position, wherein the basket and the lever are arranged to have a first distance between an upper portion of the basket and the lever; and a stopper that is coupled to the rail based on a position of the lever and that is configured to stop the moving basket, wherein the upper portion of the basket and the lever are configured to be pressed at the same time by fingers of the user when the user manipulates the lever to move the moving basket.

2. The refrigerator of claim 1, wherein the third opening is configured to allow the user's finger to be inserted via the third opening.

3. The refrigerator of claim 1, wherein the rail includes:

a first rail that is coupled to a first side of the first door, and a second rail that is coupled to a second side of the first door.

4. The refrigerator of claim 3, wherein the first rail and the second rail are coupled to a surface of the first door that faces the storage compartment, and wherein the first rail and the second rail are invisible from an exterior of the cabinet through the first opening.

5. The refrigerator of claim 3, wherein the supporting unit includes a first supporting unit and a second supporting unit, the lever includes a first lever and a second lever, and the stopper includes a first stopper and a second stopper.

6. The refrigerator of claim 5, wherein the first supporting unit, the first lever, and the first stopper are located at a first side of the moving basket, and wherein the second supporting unit, the second lever, and the second stopper are located at a second side of the moving basket.

7. The refrigerator of claim 6, wherein the first supporting unit is configured to couple with the first rail and the second supporting unit is configured to couple with the second rail.

8. The refrigerator of claim 1, wherein the rail includes:

a rail body that is vertically extended and guides a vertical movement of the moving basket; and a plurality of rail holes that specifies a location of the moving basket.

9. The refrigerator of claim 8, wherein the stopper is configured to be selectively hooked to each of the plurality of rail holes, and wherein the supporting unit includes an upper supporting unit located above the stopper to define an upper vertical supporting point and a lower supporting unit located below the stopper to define a lower vertical supporting point.

10. The refrigerator of claim 1, further comprising:

a lever shaft about which the lever is configured to rotate, and a stopper shaft about which the stopper is configured to rotate.

11. The refrigerator of claim 1, further comprising:

one or more springs that are coupled to at least one of the lever and the stopper and that are configured to, based on the user's manipulation of the lever, contract or extend to move at least one of the lever and the stopper.

12. The refrigerator of claim 11, wherein the moving frame is rectangular-shaped, and wherein the bridge is extended from the moving frame toward the basket.

13. The refrigerator of claim 12, wherein the moving frame includes, a first frame portion that is located at a first side of the bridge, and a second frame portion that is located at a second side of the bridge.

14. The refrigerator of claim 1, further comprising:

a bracket that couples the bridge to the moving frame.

15. The refrigerator of claim 14, wherein the bracket couples the supporting unit, the lever, and the stopper to the moving frame, and wherein the lever and the stopper are configured to rotate.

16. The refrigerator of claim 15, wherein the bracket is configured to accommodate at least a portion of the supporting unit, the lever, and the stopper, and wherein the bridge is coupled to the bracket and is configured to cover the portion of the supporting unit, the lever, and the stopper.

17. The refrigerator of claim 1, wherein a press portion of the lever is extended to an inner portion of the first opening.

18. The refrigerator of claim 17, wherein the press portion of the lever is located under the basket.

19. The refrigerator of claim 18, wherein a front end of the press portion of the lever is located behind a front end of the basket.

20. A refrigerator comprising:

a cabinet that includes a storage compartment and an opening to the storage compartment;

a door that is configured to cover the opening to the storage compartment;

a moving basket that includes:

a basket that is located at the door, a moving frame arranged above the basket, the moving frame including a first opening through which an object passes to be stored in the basket, wherein a second opening is between the moving frame and the basket, and a bridge that couples the basket to the moving frame;

a rail that is coupled to the door and that is configured to guide the moving basket;

a supporting unit that is projected from the bridge toward the rail and that supports the moving basket;

a lever that is located at a lower portion of the basket and that is configured to, based on manipulation of a user, move between a first position and a second position, wherein the basket and the lever are arranged to have a first distance between an upper portion of the basket and the lever; and a stopper that is coupled to the rail based on a position of the lever and that is configured to stop the moving basket, wherein the upper portion of the basket and the lever are configured to be pressed at the same time by fingers of the user when the user manipulates the lever to move the moving basket.

* * * * *